US011512365B2

(12) United States Patent
Lee et al.

(10) Patent No.: US 11,512,365 B2
(45) Date of Patent: Nov. 29, 2022

(54) WIRE ROD WITH EXCELLENT STRENGTH AND DUCTILITY AND MANUFACTURING METHOD THEREFOR

(71) Applicant: POSCO, Pohang-si (KR)

(72) Inventors: Hyong-Jik Lee, Pohang-si (KR); Yum-Ho Choi, Pohang-si (KR)

(73) Assignee: POSCO, Pohang-si (KR)

( * ) Notice: Subject to any disclaimer, the term of this patent is extended or adjusted under 35 U.S.C. 154(b) by 462 days.

(21) Appl. No.: 16/468,438

(22) PCT Filed: Nov. 23, 2017

(86) PCT No.: PCT/KR2017/013392

§ 371 (c)(1),
(2) Date: Jun. 11, 2019

(87) PCT Pub. No.: WO2018/110851

PCT Pub. Date: Jun. 21, 2018

(65) Prior Publication Data

US 2021/0285070 A1 Sep. 16, 2021

(30) Foreign Application Priority Data

Dec. 16, 2016 (KR) ..... 10-2016-0172854

(51) Int. Cl.

| | |
|---|---|
| ***C21D 9/52*** | (2006.01) |
| ***C21D 6/00*** | (2006.01) |
| ***C21D 8/06*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C21D 9/525* (2013.01); *C21D 6/005* (2013.01); *C21D 6/008* (2013.01); *C21D 8/065* (2013.01); *C22C 38/001* (2013.01); *C22C 38/02* (2013.01); *C22C 38/04* (2013.01); *C22C 38/06* (2013.01); *C21D 2211/001* (2013.01); *C21D 2211/005* (2013.01)

(58) Field of Classification Search

CPC ..... C21D 9/525; C21D 6/005; C21D 6/008; C21D 8/065; C21D 2211/001; C21D 2211/005; C22C 38/001; C22C 38/02; C22C 38/04; C22C 38/06

See application file for complete search history.

(56) References Cited

U.S. PATENT DOCUMENTS

| | | | |
|---|---|---|---|
| 4,619,714 | A | 10/1986 | Thomas et al. |
| 2017/0298471 | A1 | 10/2017 | Lee et al. |

FOREIGN PATENT DOCUMENTS

| | | | | |
|---|---|---|---|---|
| CN | 102549174 | A | | 7/2012 |
| CN | 103060678 | A | * | 4/2013 |
| CN | 103060678 | A | | 4/2013 |
| EP | 3093358 | A1 | | 11/2016 |
| JP | 5-295486 | A | | 11/1993 |
| JP | 2000-104115 | A | | 4/2000 |
| JP | 2003-525354 | A | | 8/2003 |
| JP | 2005-307246 | A | | 11/2005 |
| JP | 2009091636 | A | * | 4/2009 |
| JP | 2012-224884 | A | | 11/2012 |
| JP | 2012-229455 | A | | 11/2012 |
| JP | 2016-160467 | A | | 9/2016 |
| KR | 10-1253823 | B1 | | 12/2011 |
| KR | 10-2013-0050138 | A | | 5/2013 |
| KR | 10-2013-0140183 | A | | 12/2013 |
| KR | 10-2016-0071506 | A | | 6/2016 |
| WO | 01/64969 | A1 | | 9/2001 |
| WO | 2015/190422 | A1 | | 12/2015 |
| WO | 2016/072679 | A1 | | 5/2016 |

OTHER PUBLICATIONS

Chinese Office Action dated Jul. 17, 2020 issued Chinese Patent Application No. 201780077282 7 (with English translation).
Japanese Office Action dated Sep. 1, 2020 issued in Japanese Patent Application No. 2019-531749.
Extended European Search Report dated Sep. 24, 2019 issued in European Patent Application No. 17881311.9.
International Search Report issued in corresponding International Application No. PCT/KR2017/013392, dated Apr. 6, 2018.
C.H. Seo, et al., Deformation Behavior or Ferrite-Austenite Duplex Lightweight Fe—Mn—Al—C Steel, Scripta Materialia 66, Jan. 2, 2012, pp. 519-522.

* cited by examiner

*Primary Examiner* — Robert S Jones, Jr.
*Assistant Examiner* — Jiangtian Xu
(74) *Attorney, Agent, or Firm* — Morgan, Lewis & Bockius LLP

(57) ABSTRACT

Disclosed are a wire rod and a manufacturing method therefor, the wire rod comprising, by weight %: 0.05-0.20% of C, 0.2% or less of Si, 5.0-6.0% of Mn, 0.020% or less of P, 0.020% or less of S, 0.010-0.050% of Al, 0.010-0.020% of N, and a balance of Fe and inevitable impurities and having a microcrystalline structure composed of two phases of austenite and ferrite, wherein the austenite has an area fraction of 15-25%.

5 Claims, No Drawings

WIRE ROD WITH EXCELLENT STRENGTH AND DUCTILITY AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/013392, filed on Nov. 23, 2017, which in turn claims the benefit of Korean Patent Application No. 10-2016-0172854, filed Dec. 16, 2016, the entire disclosures of which applications are incorporated by reference herein.

TECHNICAL FIELD

The present disclosure relates to a wire rod with excellent strength and ductility and a manufacturing method therefor, and more particularly to a wire rod with excellent strength and ductility which may preferably be used as a material for industrial machines parts or machine parts such as automobiles, which are exposed to various external load environments, and a manufacturing method therefor.

BACKGROUND ART

Efforts in order to reduce emissions of carbon dioxide, which has recently been cited as a major cause of environmental pollution, have become a global issue. As a part of this, there is also an act regulating the exhaust gas of automobiles, and as a countermeasure, automakers are trying to solve this problem by improving fuel efficiency. However, in order to improve fuel efficiency, since weight reductions and high performance of automobiles are required, the necessity of high strength of materials or parts for automobiles is increasing. In addition, since stability against external impacts is increasing, ductility is also recognized as an important property of materials or parts.

A ferrite or pearlite structure in a wire rod has a limitation in securing high strength and high ductility. Since a material having the ferrite or pearlite structure generally has high ductility and relatively low strength, when cold drawing is performed, high strength may be obtained to increase strength. On the other hand, ductility may decrease rapidly in proportion to an increase in strength, which is a disadvantage.

Therefore, in general, in order to simultaneously implement high strength and high ductility, a bainite structure or a tempered martensite structure is used. However, in order to obtain such a microstructure, an additional heat treatment is required, which is disadvantageous in terms of economy.

In many industrial machines and automobile parts, there is increasing demand not only for high strength but also for high ductility, and there is a demand for the development of wire rods having the above-mentioned characteristics.

DISCLOSURE

Technical Problem

An aspect of the present disclosure is to provide a wire rod with excellent strength and ductility without any additional heat treatment, and a manufacturing method therefor.

Technical Solution

According to an aspect of the present disclosure, a wire rod may include: by weight (%), 0.05 to 0.20% of carbon (C), 0.2% or less of silicon (Si), 5.0 to 6.0% of manganese (Mn), 0.020% or less of phosphorus (P), 0.020% or less of sulfur (S), 0.010 to 0.050% of aluminum (Al), 0.010 to 0.020% of nitrogen (N), a balance of iron (Fe) and inevitable impurities and having a microstructure composed of two phases of austenite and ferrite.

According to another aspect of the present disclosure, a manufacturing method of a wire rod may include steps of: by weight (%), reheating a steel material including 0.05 to 0.20% of carbon (C), 0.2% or less of silicon (Si), 5.0 to 6.0% of manganese (Mn), 0.020% or less of phosphorus (P), 0.020% or less of sulfur (S), 0.010 to 0.050% of aluminum (Al), 0.010 to 0.020% of nitrogen (N), a balance of iron (Fe) and inevitable impurities at a temperature within a range of 600° C. to 700° C., performing a finish hot rolling the reheated steel material at a temperature within a range of 600° C. to 700° C. at a hot percent reduction of area of 80% or more, to obtain a wire rod, and performing air cooling the wire rod.

Advantageous Effects

According to an aspect of the present disclosure, a wire rod according to the present disclosure is excellent in strength and ductility, and thus the wire rod may preferably be used as a material for machine parts such as industrial machine parts or machine parts such as automobiles, which are exposed to various external load environments.

In addition, a wire rod according to the present disclosure may secure excellent strength and ductility without additional heat treatment, which is advantageous in terms of economy.

The various and advantageous advantages and effects of the present invention are not limited to the above description, and can be more easily understood in the course of describing a specific embodiment of the present invention.

BEST MODE FOR INVENTION

Hereinafter, a wire rod having excellent strength and ductility, which is an aspect of the present disclosure, will be described in detail.

First, an alloy component and a preferable content range of the wire rod of the present disclosure will be described in detail. It is noted that the content of each component is based on weight unless otherwise specified.

C: 0.05 to 0.20%

Carbon (C) is an essential element for securing strength, is dissolved in steel, or is present in a form of carbide or cementite. The easiest way to increase the strength is to increase a content of carbon to form carbide or cementite, but since ductility and impact toughness decrease, it is necessary to adjust an addition amount of carbon within a certain range. In the present disclosure, it is preferable to add the content of carbon in a range of 0.05 to 0.20%. When the content of carbon is less than 0.05%, target strength is difficult to obtain, and when the content of carbon exceeds 0.20%, the ductility and impact toughness may drastically decrease.

Si: 0.2% or Less (Excluding 0%)

Silicon (Si) is an element dissolved in ferrite when added, contributing to increasing strength through solid solution strengthening of a steel material, but in the present disclosure, Si is not intentionally added, and there is no problem in securing properties even when silicon (Si) is not added. However, 0% is excluded in consideration of an amount which is inevitably added for manufacturing. Meanwhile, when silicon is added, ductility and impact toughness are drastically reduced, such that an upper limit thereof is limited to 0.2%.

Mn: 5.0 to 6.0%

Manganese (Mn) is an element dissolved in austenite to significantly stabilize an austenite phase and increasing a stacking fault energy to promote dislocation multiplication and formation of deformation twin. In a manufacturing process of the present disclosure, an addition amount of manganese (Mn) may be adjusted within a certain range to form a two phase structure composed of ferrite and stable austenite during reheating and hot rolling. In the present disclosure, it is preferable that a content of manganese (Mn) is in a range of 5.0 to 6.0%. When the content of manganese (Mn) is less than 5.0%, it is difficult to sufficiently obtain the above-mentioned effect, and when the content of manganese (Mn) exceeds 6.0%, an inside of a material may be ununiform due to segregation during solidification, and surface cracks may occur even during hot rolling.

P: 0.020% or Less

P is an impurity inevitably contained in steel, and is preferably not contained, since it is segregated at a grain boundary to lower toughness of the steel, and reduce delayed fracture resistance. Therefore, an upper limit thereof is limited to 0.020% in the present disclosure.

S: 0.020% or Less

S is an impurity inevitably contained in steel, and is preferably not contained, since it is segregated at a grain boundary to lower toughness of the steel, similar to P, and form a low melting point emulsion so as to inhibit hot rolling. Thus, an upper limit thereof is limited to 0.020% in the present disclosure.

Al: 0.010 to 0.050%

Al is a powerful deoxidizing element, and allows oxygen to be removed from steel so as to improve cleanliness. In addition, Al is combined with nitrogen dissolved in steel to form aluminum nitride (AlN), and may improve ductility and impact toughness. In the present disclosure, aluminum is positively added, but when a content of Al is less than 0.010%, an addition effect thereof is difficult to expect. When a content of Al exceeds 0.050%, a large amount of alumina inclusions are generated, thereby significantly reducing mechanical properties. Therefore, in the present disclosure, the content of Al is limited within a range of 0.010 to 0.050%.

N: 0.010 to 0.020%

Nitrogen is an element which forms a nitride to make crystal grains finer to improve strength and ductility. When a content of nitrogen is less than 0.010%, the above-mentioned effect is difficult to expect. When a content of nitrogen exceeds 0.020%, an amount of nitrogen dissolved in the steel increases to lower cold forging property, which is not preferable.

A remainder of the above-mentioned composition is iron (Fe). However, since inevitable impurities which are not intended from raw materials or surrounding environments is able to inevitably incorporated, in a manufacturing process in the related art, they may not be excluded. These impurities are not specifically mentioned in the present specification, as they are known to anyone in the skilled art.

Meanwhile, when designing an alloy of a steel material having the above-mentioned composition range, it is preferable to control contents of Mn and Si to satisfy the Relational Expression 1 below.

$$[Mn]/[Si] \geq 25 \quad \text{[Relational Expression 1]}$$

(where, each of [Mn] and [Si] means the content (by weight %) of the corresponding element).

In the present disclosure, manganese is an element stabilizing an austenite phase and greatly expands an austenite region to a low temperature on a phase diagram. Silicon is dissolved in the steel to increase the strength, but silicon greatly reduces the ductility. As a result of extensive researches and experiments focusing on this point, the present inventors have found that when a relationship between the manganese and the silicon satisfies Mn/Si≥25 by weight %, a wire rod having a two phase structure of austenite and ferrite having excellent strength and ductility may be provided.

In addition, when designing an alloy of a steel material having the above-mentioned composition range, it is preferable to control contents of Al and N to satisfy the Relational Expression 2 below.

$$1 \leq [Al]/[N] \leq 4 \quad \text{[Relational Expression 2]}$$

(Where each of [Al] and [N] means the content (by weight %) of the corresponding element).

In the present disclosure, aluminum is an element combined with nitrogen dissolved in the steel to form AlN. These nitrides serve to fix ground boundaries to make grain size finer. In order to obtain such an effect, a large amount of fine AlN should be precipitated in an amount exceeding an usual level to obtain grain refinement, and accordingly, the strength and ductility may be further improved. As a result of extensive researches and experiments focusing on this, the present inventors have found that when a relationship between the aluminum and nitrogen satisfies 1≤Al/N≤4, a wire rod having excellent strength and ductility may be provided.

Hereinafter, a microstructure of a wire rod having excellent in strength and ductility of the present disclosure will be described in detail.

A microstructure of a wire rod of the present disclosure is composed of two phases of austenite and ferrite, and an area fraction of austenite is 15 to 25%. The area fraction of austenite may be controlled through a combined control of a reheating temperature and a rolling temperature of a steel material, in addition to an alloy composition. When the area fraction of austenite corresponds to the above-mentioned range, excellent mechanical properties may be secured.

According to an example, austenite and ferrite may have a lamellar structure in a form of a lath. In this case, an inter-lamellar spacing may be 0.2 μm or less (excluding 0 μm). When the inter-lamellar spacing exceeds 0.2 μm, strength and ductility may be deteriorated. For reference, a control of the inter-lamellar spacing may be achieved through a hot percent reduction of area control.

According to an example, a density of dislocation formed inside the lath may be $1.0\times10^{15}$ or more. As will be described later, in the present disclosure, rolling under a high pressure is performed in a two phase region of austenite and ferrite having a relatively low temperature, such that the density of dislocation inside a matrix structure becomes very high. This may result in some strength improvement.

According to an example, the wire rod of the present disclosure includes aluminum nitride (AlN), and a maximum circular equivalent diameter of the AlN may be 30 nm or less (excluding 0 nm). When the maximum circular equivalent diameter exceeds 30 nm, it may be difficult to effectively fix grain boundaries. For reference, when the control of the maximum circular equivalent diameter of AlN may be achieved by controlling the reheating temperature of the steel material, and when the maximum circular equivalent diameter exceeds 30 nm, and is coarse, it is preferable that the maximum circular equivalent diameter is 30 nm or less by lowering the reheating temperature of the steel material.

The wire rod of the present disclosure has an advantage of excellent strength and ductility, and according to an example, tensile strength may be 1200 to 1400 MPa, and elongation may be 30% or more.

The wire rod of the present disclosure described above may be manufactured by various methods, and a manufacturing method thereof is not particularly limited. However, as a preferable example, it can be manufactured by the following method.

Hereinafter, a manufacturing method of a wire rod having excellent strength and ductility, another aspect of the present disclosure, will be described in detail.

First, in the present disclosure, a steel material having the above-mentioned composition components is prepared and then reheated. In this case, it is preferable that a reheating temperature is controlled to a temperature within a range of 600 to 700° C. In this temperature range, it is maintained for more than 1 hour to form austenite and ferrite two phase structures and then stabilize. When the reheating temperature is less than 600° C., there is almost no austenite phase, such that a desired two phase structure may not be obtained. On the other hand, when the reheating temperature exceeds 700° C., there is almost no austenite phase, and thus two phase structure may not be obtained after hot rolling. Thus, it is preferable that the reheating temperature is controlled to a temperature within a range of 600 to 700° C.

Next, the reheated steel material is finish hot rolled to obtain a wire rod. In this case, a temperature of the finish hot rolling may be controlled to a temperature within a range of 600 to 700° C., in the same manner as the reheating temperature. When the temperature of hot rolling exceeds out of the above range, stable austenite and ferrite two phase structure may not be obtained, such that it is preferable that the temperature of finish hot rolling is controlled to a temperature within a range of 600 to 700° C. Meanwhile, when finish hot rolling is performed, hot percent reduction of area is preferably 80% or more. When the hot percent reduction of area is less than 80%, the inter-lamellar spacing may be too be wide.

Next, the wire rod is air cooled. When a cooling speed is slow, grains may be coarse. On the other hand, when a cooling speed is fast, austenite may be transformed into a low temperature structure, such that cooling is preferably performed by air cooling. In the present disclosure, an air cooling rate is not particularly limited, but may be, for example, within a range of 0.2 to 2° C./sec.

Hereinafter, the present disclosure will be described in more detail with reference to embodiments. However, description of the embodiments is intended only to illustrate the present disclosure, but is not limited to the present disclosure. The scope of the present invention is determined by the matters described in the claims and the matters reasonably deduced therefrom.

MODE FOR INVENTION

Embodiment

Molten steel having an alloy composition illustrated in the following Table 1 was cast, respectively, and then is reheated and finish hot rolled under the conditions illustrated in the following Table 2, followed by air cooling to prepare a wire rod (diameter: 15 mm). In addition, volume fraction of austenite and an inter-lamella spacing between austenite and ferrite for respective wire rods are measured to be illustrated together in the following Table 2.

Thereafter, tensile strength and elongation were measured through a tensile test at a room temperature by using wire rods prepared as described above to be illustrated in the following Table 2. In this case, the area fraction of austenite (γ) was measured by using X-ray (XRD), and the inter-lamella spacing between austenite and ferrite was measured by using a transmission electron microscope (TEM). The tensile strength and elongation were measured by performing a crosshead speed at a rate of 0.9 mm/min until a yield point, and then at a speed of 6 mm/min through the tensile test at a room temperature.

TABLE 1

| Classification | Specimen No. | Alloy component (wt %) | | | | | | | [Mn]/[Si] | [Al]/[N] |
|---|---|---|---|---|---|---|---|---|---|---|
| | | C | Si | Mn | P | S | Al | N | | |
| Inventive Example | 1 | 0.11 | 0.10 | 5.1 | 0.009 | 0.005 | 0.018 | 0.012 | 51 | 1.5 |
| | 2 | 0.18 | 0.20 | 5.7 | 0.012 | 0.008 | 0.034 | 0.013 | 29 | 2.6 |
| | 3 | 0.07 | 0.08 | 5.3 | 0.018 | 0.007 | 0.025 | 0.015 | 66 | 1.7 |
| | 4 | 0.09 | 0.13 | 5.5 | 0.010 | 0.009 | 0.019 | 0.011 | 42 | 1.9 |
| | 5 | 0.13 | 0.18 | 5.9 | 0.014 | 0.014 | 0.027 | 0.020 | 33 | 1.4 |
| Comparative Example | 6 | 0.10 | 0.80 | 5.2 | 0.013 | 0.010 | 0.036 | 0.011 | 7 | 3.3 |
| | 7 | 0.16 | 0.19 | 3.9 | 0.016 | 0.011 | 0.041 | 0.015 | 21 | 2.7 |
| | 8 | 0.06 | 0.08 | 7.5 | 0.013 | 0.010 | 0.023 | 0.013 | 94 | 1.8 |
| | 9 | 0.09 | 0.11 | 5.4 | 0.015 | 0.014 | 0.032 | 0.004 | 49 | 8.0 |
| | 10 | 0.12 | 0.16 | 5.6 | 0.017 | 0.015 | 0.039 | 0.017 | 35 | 2.3 |
| | 11 | 0.15 | 0.17 | 5.5 | 0.014 | 0.016 | 0.029 | 0.016 | 32 | 1.8 |
| | 12 | 0.11 | 0.12 | 5.8 | 0.016 | 0.013 | 0.015 | 0.014 | 48 | 1.1 |

TABLE 2

| Classification | Specimen No. | Reheating temperature(° C.) | Hot rolling temperature(° C.) | Hot percent reduction of area (%) | Y fraction (area %) | Inter-lamelia spacing (μm) | Tensile strength (MPa) | Elongation (%) |
|---|---|---|---|---|---|---|---|---|
| Inventive Example | 1 | 630 | 685 | 80 | 21 | 0.18 | 1210 | 31 |
| | 2 | 670 | 619 | 90 | 20 | 0.12 | 1302 | 33 |
| | 3 | 650 | 637 | 83 | 22 | 0.17 | 1238 | 32 |
| | 4 | 620 | 654 | 95 | 17 | 0.10 | 1363 | 34 |
| | 5 | 640 | 668 | 84 | 20 | 0.16 | 1245 | 32 |
| Comparative Example | 6 | 690 | 645 | 96 | 15 | 0.10 | 1421 | 23 |
| | 7 | 645 | 661 | 86 | 10 | 0.15 | 1182 | 36 |
| | 8 | 663 | 678 | 90 | 37 | 0.13 | 1456 | 20 |
| | 9 | 634 | 626 | 81 | 22 | 0.66 | 1093 | 30 |
| | 10 | 850 | 672 | 89 | 35 | 0.45 | 1135 | 31 |

TABLE 2-continued

| Classification | Specimen No. | Reheating temperature(° C.) | Hot rolling temperature(° C.) | Hot percent reduction of area (%) | Y fraction (area %) | Inter-1amelia spacing (μm) | Tensile strength (MPa) | Elongation (%) |
|---|---|---|---|---|---|---|---|---|
| | 11 | 686 | 500 | 88 | 8 | 0.14 | 1158 | 37 |
| | 12 | 652 | 635 | 50 | 33 | 0.35 | 1176 | 31 |

As illustrated in Tables 1 and 2, in the case of Specimens 1 to 5 satisfying both the alloy composition and the process condition proposed in the present disclosure, it can be confirmed austenite area fraction is properly controlled to 15 to 25%, and an inter-lamellar spacing between the austenite and the ferrite is also properly controlled to 0.2 μm or less. Accordingly, excellent mechanical properties (tensile strength of 1200 to 1400 MPa and elongation of 30% or more) were illustrated.

On the contrary, Specimen 6 illustrates a case in which silicon is out of the scope of the present disclosure, and in Specimen 6, Relational Expression 1 was not satisfied, and the tensile strength was greatly increased and the ductility was deteriorate due to a strengthening effect of silicon.

Specimen 7 illustrates a case in which the content of manganese falls outside of the scope of the present disclosure, and in Specimen 7, Relational Expression 1 was not also satisfied but also an austenite volume fraction was too low and the strength was deteriorated.

Specimen 8 illustrates a case in which the content of manganese exceeds outside of the scope of the present disclosure while satisfying the Relational Evaluations 1 and 2. In Specimen 8, contrary to Specimen 7, not only the austenite volume fraction was too high, but also the ductility was deteriorated due to the martensite deformation during cooling due to a decrease in the content of carbon in austenite.

Specimen 9 illustrates a case in which the content of nitrogen falls outside of the scope of the present disclosure. In Specimen 9, Relational Expression 2 was not satisfied and an inter-lamellar spacing was increased and the strength was deteriorated due to little AlN formation, effective for grain refinement.

Specimen 10 illustrates a case in which a component of steel satisfies the scope of the present disclosure and satisfies Relational Expressions 1 and 2, but a reheating temperature is too high. In Specimen 10, the austenite volume fraction was too excessively increased, the inter-lamellar spacing was increased, and the strength was deteriorated.

Specimen 11 illustrates a case in which a component of steel satisfies the scope of the present disclosure and satisfies Relational Expressions 1 and 2, but a hot rolling temperature is too low. In Specimen 11, the austenite volume fraction was greatly reduced, and the strength was deteriorated due to less transformation organic martensite formation during deformation.

Comparative Example 12 illustrates a case in which a component of steel satisfies the scope of the present disclosure, satisfies Relational Expressions 1 and 2, but a hot percent reduction of area is too small. In Comparative Example 12, an inter-lamella spacing between austenite and ferrite was greatly increased and the strength was deteriorated.

While exemplary embodiments have been shown and described above, it will be apparent to those skilled in the art that modifications and variations could be made without departing from the scope of the present invention as defined by the appended claims.

The invention claimed is:

1. A wire rod, by weight %, comprising:

0.05 to 0.20% of carbon (C), 0.2% or less of silicon (Si), 5.0 to 6.0% of manganese (Mn), 0.020% or less of phosphorus (P), 0.020% or less of sulfur (S), 0.010 to 0.050% of aluminum (Al), 0.010 to 0.020% of nitrogen (N), a balance of iron (Fe) and inevitable impurities, and having a microstructure composed of two phases of austenite and ferrite, wherein an area fraction of austenite is 15 to 25%, wherein the microstructure of the wire rod has a lamellar structure of austenite and ferrite in a form of a lath, wherein an inter-lamellar spacing is 0.2 μm or less, excluding 0 μm, and wherein the following Relational Expression 2 is satisfied, $$1 \leq [Al]/[N] \leq 4 \quad \text{[Relational Expression 2]}$$

where, each of [Al] and [N] means a content (by weight %) of the corresponding element.

2. The wire rod of claim 1, wherein the following Relational Expression 1 is satisfied, $$[Mn]/[Si] \geq 25 \quad \text{[Relational Expression 1]}$$

(where, each of [Mn] and [Si] means a content (by weight %) of the corresponding element).

3. The wire rod of claim 1, wherein a dislocation density formed inside the lath is $1.0 \times 10^{15}$ $m^{-2}$ or more.

4. The wire rod of claim 1, wherein the wire rod comprises aluminum nitride (AlN), and a maximum circle equivalent diameter of the AlN is 30 nm or less, excluding 0 nm.

5. The wire rod of claim 1, wherein a tensile strength is 1200 to 1400 MPa and elongation is 30% or more.

* * * * *